US009066173B2

(12) United States Patent
Wang

(10) Patent No.: US 9,066,173 B2
(45) Date of Patent: Jun. 23, 2015

(54) METHOD FOR PRODUCING OPTIMUM SOUND FIELD OF LOUDSPEAKER

(71) Applicant: NATIONAL CHENG KUNG UNIVERSITY, Tainan (TW)

(72) Inventor: Ta-Chung Wang, Tainan (TW)

(73) Assignee: National Cheng Kung University, Tainan (TW)

( * ) Notice: Subject to any disclaimer, the term of this patent is extended or adjusted under 35 U.S.C. 154(b) by 414 days.

(21) Appl. No.: 13/709,225

(22) Filed: Dec. 10, 2012

(65) Prior Publication Data

US 2014/0016801 A1 Jan. 16, 2014

(30) Foreign Application Priority Data

Jul. 11, 2012 (TW) ..... 101125003 A

(51) Int. Cl.
*H04R 5/02* (2006.01)
*H04S 3/00* (2006.01)

(52) U.S. Cl.
CPC *H04R 5/02* (2013.01); *H04S 3/002* (2013.01); *H04S 2400/11* (2013.01)

(58) Field of Classification Search
None
See application file for complete search history.

(56) References Cited

U.S. PATENT DOCUMENTS

| | | | | |
|---|---|---|---|---|
| 3,824,342 | A * | 7/1974 | Christensen et al. | 381/20 |
| 4,119,798 | A * | 10/1978 | Iwahara | 381/19 |
| 5,862,227 | A * | 1/1999 | Orduna-Bustamante et al. | 381/17 |
| 8,638,946 | B1 * | 1/2014 | Mahabub | 381/17 |
| 2008/0056517 | A1 * | 3/2008 | Algazi et al. | 381/310 |
| 2011/0249825 | A1 * | 10/2011 | Ise | 381/56 |
| 2011/0261973 | A1 * | 10/2011 | Nelson et al. | 381/92 |
| 2011/0293108 | A1 * | 12/2011 | Mejia et al. | 381/92 |
| 2012/0020485 | A1 * | 1/2012 | Visser et al. | 381/57 |
| 2012/0288124 | A1 * | 11/2012 | Fejzo et al. | 381/303 |

* cited by examiner

*Primary Examiner* — Wayne Young
*Assistant Examiner* — Mark Fischer
(74) *Attorney, Agent, or Firm* — Rosenberg, Klein & Lee

(57) ABSTRACT

A method for producing an optimum sound field of loudspeakers is revealed. Firstly enclose a surface of a human head with a first closed geometric shape. Then enclose the first closed geometric shape with at least one second closed geometric shape. Next set up reference points on the first and second closed geometric shapes respectively. Use signal strength of the reference point on the second closed geometric shape and a gradient of the corresponding reference points on the first and second closed geometric shapes to obtain a transfer function of each point between a virtual loudspeaker/a real loudspeaker and the sound field respectively. Then create a virtual sound field and a real sound field according to the above transfer functions. Finally, get an optimum signal of the real loudspeaker by minimizing an error between the virtual sound field and the real sound field with a boundary condition.

9 Claims, 4 Drawing Sheets

METHOD FOR PRODUCING OPTIMUM SOUND FIELD OF LOUDSPEAKER

BACKGROUND OF THE INVENTION

1. Field of the Invention

The present invention relates to a method for producing an optimum sound field of loudspeakers, especially to a method for producing an optimum sound field of loudspeakers in which reference points are set around a required sound field to get audio signals and related gradient on the boundary and an optimization method is used to calculate output signals of each loudspeaker for producing a sound field required. Thus the listeners can still get best sounds even they turn their heads or move around.

2. Description of Related Art

The conventional stereophonic recording methods were firstly developed by Blumlein. Later, an integrated and multi-level environment such as Dolby Digital or digital theater system (DTS) surrounding technology is produced by a plurality set of loudspeakers so as to pursue a virtual reality stereo system and a better acoustic environment. Generally, stereophonic sound can be achieved by using at least two audio channels, through a configuration of several loudspeakers, to provide sound heard from various directions, as in natural hearing. In theaters or cinemas, a plurality of loudspeakers is placed around a performance space to surround the audience, allowing the audience to hear sounds coming from all around them. This is wave field synthesis (WFS) technique that creates virtual acoustic environments by a large number of loudspeakers.

Moreover, due to fast progress of technology and higher standard of living, people have higher requirements for electronic devices that display images and sounds. They concern not only the image quality, but also the quality of the sound field. However, the surround loudspeaker distribution formed by placement of a plurality of loudspeakers is of high cost. In a confined or narrow area such as parlors or rooms, the optimal placement of the loudspeakers may not easily be achieved. In 1992, Dolby laboratory has developed surround sound multichannel audio system 5.1 by using digital audio encoding technologies. The 5.1 surround sound system is the most common in home theaters. The 5.1 surround sound speaker system includes five speakers-two left and right front speakers, two left and right rear speakers, a quality center speaker, and a powered subwoofer for deep, rumbling bass tones. Except the subwoofer, other speakers are highly directional so as to create a surround sound field. When users are in such sound field, they have an optimum surround sound experience at home as in the theater. In order to provide optimum sound quality, the placement of the speakers needs to meet certain requirements of angles and distances to the listener. However, these requirements are often at odds with the space constraints such as a limited space in vehicles or a compact room arrangement. Thus the best placement of the speakers is unable to be achieved and users can't get an even, all-surrounding audio experience.

A technique that reproduces optimum stereo sound by small-scale loudspeaker array units has been developed. It's based on the ability of humans to localize sound sources by two binaural cues-interaural time differences of arrival and interaural intensity differences. The time difference is defined as the difference in arrival time of a sound at the left and right ears while the intensity difference is the amplitude difference generated between the right and left ears. A head related transfer function (HRTF) is used to simulate surround sound playback from loudspeakers fixed at certain positions. By adjusting audio frequency and delay of HRTF, stereo sounds are simulated and played by the fixed loudspeakers. The conventional HRTF describes time and amplitude differences of binaural response for a listener. The differences are generated due to anatomical structure of the listener's head and pinnae and are used to detect the position of the sound source. The technique by using binaural time differences and amplitude differences, together with reverberation, chorus to have auditory perception is called duplex theory. Refer to FIG. 4, a schematic drawing showing a sound field produced between two ears of a listener by duplex theory is revealed. But this technique has two shortcomings. One of the limitations of the duplex theory is that it doesn't differentiate sounds coming from the front and the sounds from the rear due to symmetry of the listener's head assumed in the duplex theory. The other is that an optimum sound field synthesized by duplex theory is around two ears of the listener. Once the listener turns the head or shifts the body, the two ears leave the range of the optimum sound field. This affects the auditory perception and even causes the listener having uncomfortable feelings.

Thus there is a room for improvement and a need to provide a novel method for producing a sound field.

SUMMARY OF THE INVENTION

The primary object of the present invention is to provide a method for producing an optimum sound field by loudspeakers in which reference points are set up around a sound field to get audio signals and related gradient on boundary of the sound field. An optimization method is used to calculate output signals of each loudspeaker for producing the sound field required. Thus the listeners can still get best sounds even when they turn their heads a bit or move their bodies.

In order to achieve the above object, a method for producing an optimum sound field of loudspeakers of the present invention includes a plurality of steps. Firstly, enclose a surface of a human head region with a first closed geometric shape. The first closed geometric shape can be a triangle, a square, a circle, an ellipse, etc. Then enclose the first closed geometric shape with at least one second closed geometric shape, outside the human head region. The first closed geometric shape and the second closed geometric shape are corresponding to each other with similar geometric shape. Next set up a plurality of reference points on the first closed geometric shape and on the second closed geometric shape respectively. The position of each reference point on the first closed geometric shape is corresponding to the position of each reference point on the second closed geometric shape. Later, use signal strength of the reference point on the second closed geometric shape, and a gradient of the signal strength of the reference points obtained from the corresponding reference points on the first and the second closed geometric shapes to obtain a transfer function from a virtual loudspeaker/a real loudspeaker to each point of the sound field respectively. Then create a virtual sound field and a real sound field according to the transfer function of the virtual loudspeaker and the transfer function of the real loudspeaker respectively. At last, obtain an optimum signal of the real loudspeaker by minimizing an error between the virtual sound field and the real sound field with a boundary condition. In the method mentioned above, the method for obtaining an optimum signal of the real loudspeaker includes a pseudo-inverse matrix method.

In the method mentioned above, the boundary condition is that the convolution of the transfer function from the real loudspeaker to each point of the sound field and sound source signal of the real loudspeaker is equal to the real sound field.

In the method mentioned above, the number of the real loudspeakers is smaller than the number of the reference points.

In the method mentioned above, the intervals between two adjacent reference points are all the same.

In the method mentioned above, the first closed geometric shape and the second closed geometric shape are preferred to be concentric circles with different radii.

Thereby a virtual loudspeaker is synthesized within a limited range around the listener's head and is in a desired direction. Thus no matter the listener's head is turned or the body is shifted or moved a bit but the head is still within a certain range, the direction of the virtual loudspeaker the listener perceived remains the same Moreover, there is no need to place a plurality of loudspeakers on the boundary for producing the sound field required. Thus not only the problem of the placement of loudspeakers restricted by limited space at home can be solved, the huge cost involved in buying the loudspeakers is also saved. Therefore users have a higher acceptance and usage of the present invention and the present invention can be widely adopted.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
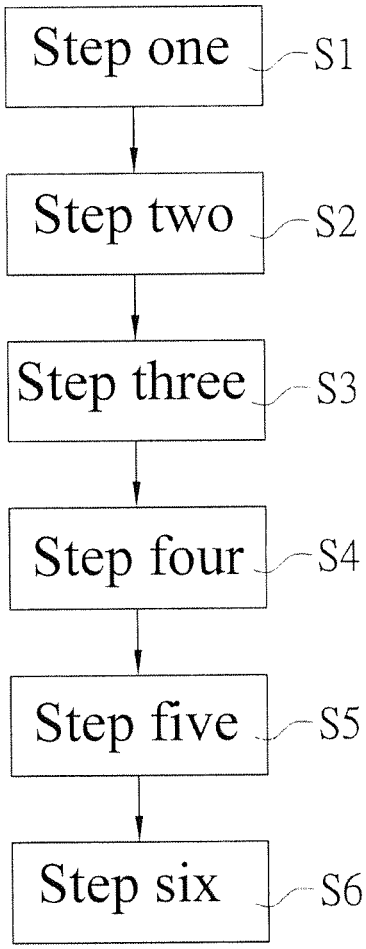
FIG. 1 is a flow chart showing steps of an embodiment according to the present invention.
Figure 2:
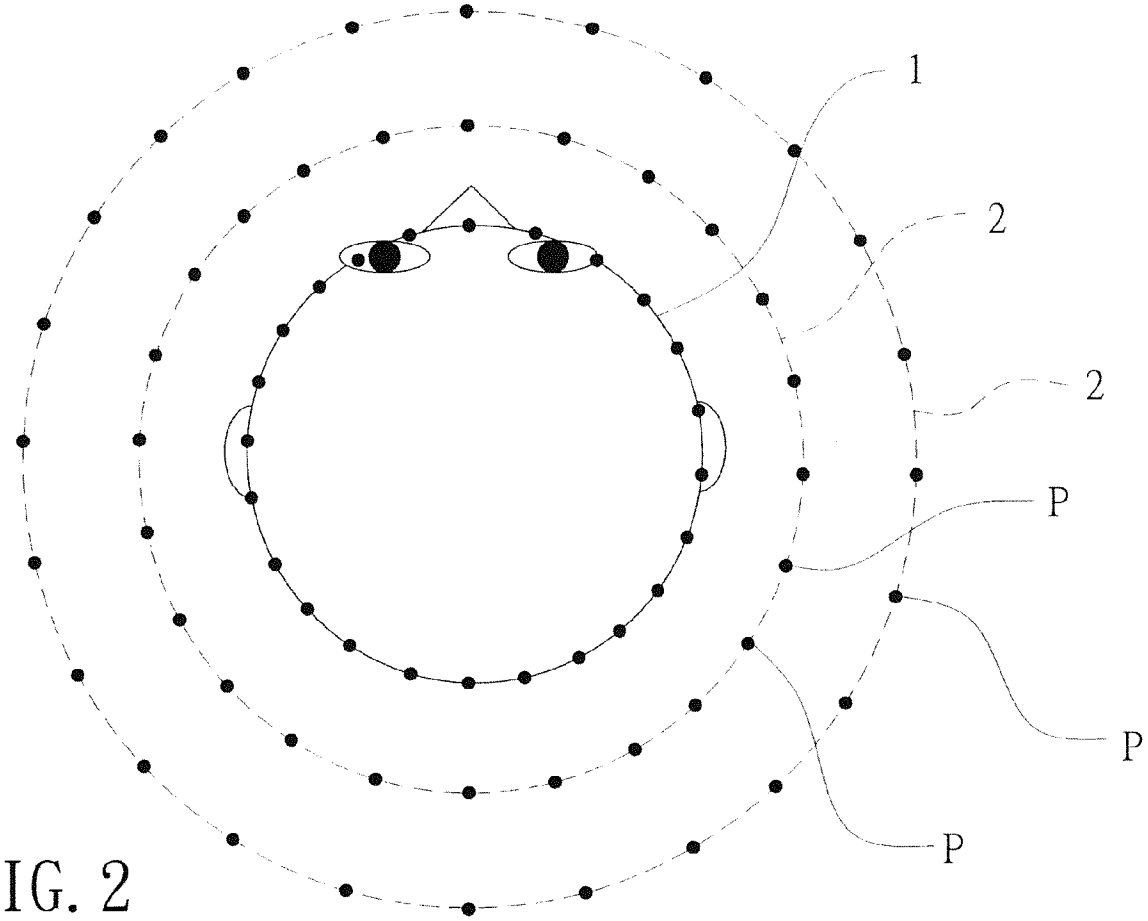
FIG. 2 is a schematic drawing showing reference points of a sound filed around a listener's head according to the present invention.

Refer to FIG. 1, a flow chart showing steps of a method for producing an optimum sound field of loudspeakers is revealed. The method for producing an optimum sound field of loudspeakers includes following steps:

Step one (S1): enclosing a surface of a human head region with a first closed geometric shape 1. The first closed geometric shape 1 can be a triangle, a square, a circle, an ellipse, etc. In this embodiment, the first closed geometric shape 1 is a circle enclosing the head region. Also refer to FIG. 2.

Step two (S2): enclosing the first closed geometric shape 1 with at least one second closed geometric shape 2, outside the human head region. The first closed geometric shape 1 and the second closed geometric shape 2 are corresponding to each other with similar geometric shape. In this embodiment, the first closed geometric shape 1 and the second closed geometric shape 2 are concentric circles with different radii.

Step three (S3): setting up a plurality of reference points P on the first closed geometric shape 1 and on the second closed geometric shape 2 respectively. The position of each reference point P on the first closed geometric shape 1 is corresponding to the position of each reference point P on the second closed geometric shape 2.

Step four (S4): using signal strength of the reference point P on the second closed geometric shape 2 and a gradient of the reference points P corresponding to each other on the first and the second closed geometric shapes 1, 2 to form a transfer function from a virtual loudspeaker/a real loudspeaker to each point of a sound field respectively;

Step five (S5): creating a virtual sound field and a real sound field according to the transfer function of the virtual loudspeaker and the transfer function of the real loudspeaker respectively; and Step six (S6): obtaining an optimum signal of the real loudspeaker by minimizing an error between the virtual sound field and the real sound field with a boundary condition.

Moreover, the number of the real loudspeakers is smaller than the number of the reference points P. The following embodiment further reveals application range of the present invention but not intended to limit the present invention.

The audio signals enclosing the surface of the human head region and their gradients represent the sound people can hear. Thus there are three circles in this embodiment. One is the first closed geometric shape 1 while the rest two are the second closed geometric shapes 2. The gradient of the middle circle is computed by finite-difference approximations. Moreover, due to the ability to be discretized, several reference points P around the human head are taken to perform approximation. The radius of the first closed geometric shape 1 is ranging from 6 to 8.5 centimeters (cm) while the radius of the two second closed geometric shapes 2 are respectively between 9.5-13 cm and 11.5-18 cm. The number of the reference point P is ranging from 12 to 36. In this embodiment, the first closed geometric shape 1 whose radius is 7.5 cm is enclosing the human head region while one second closed geometric shape 2 whose radius is 12.5 cm is around the first closed geometric shape 1 and the other second closed geometric shape 2 whose radius is 17.5 cm is enclosing the above second closed geometric shape 2. Moreover, the first closed geometric shape 1 and each second closed geometric shape 2 are respectively set up 24 reference points P. The interval between two adjacent reference points P is the same as that of any other two adjacent reference points P, a 15 degree interval. The parameters mentioned above are of only an embodiment of the present invention, not intended to limit the present invention. People skilled the filed know that the radius of the first closed geometric shape 1, the radius of the second closed geometric shape 2, and the number of the reference points P can be modified.

The following mathematic equation is used to represent whole process of producing an optimum sound field of loudspeakers. It is assumed that a sound source signal of a virtual sound field SF, is represented by v. A transfer function from a virtual loudspeaker to each point of a sound field is represented by G. A sound source signal of a real sound field SF, is represented by O. A transfer function from a real loudspeaker to each point of the sound field is represented by H, M is the number of the virtual loudspeaker. N is the number of the real loudspeaker, and L is the number of the reference point P. Thus the virtual sound field and the real sound field can be respectively represented by $SF_v=vG$ and $SF_r=oH$. The vector hereof $v\epsilon R^{1\times M}$ and $o\epsilon R^{1\times N}$ respectively represent an input signal of the virtual loudspeaker and an input signal of the real loudspeaker while the matrices $G\epsilon R^{M\times L}$ and $H\epsilon R^{N\times L}$ respectively represent the transfer function from the virtual loudspeaker to each point of the sound field, and the transfer function from the real loudspeaker to each point of the sound field. Since audio signals in a sound field having no noise can be determined by signals at the boundary and their gradients, the transfer function from the virtual loudspeaker/real loudspeaker to each point of the sound field is formed by the signal strength and gradient of each reference point P on the middle circle in this embodiment. The functions of v, o, G, H are represented by the followings:

$$v = be^{-j\omega l},\ o = ee^{-j\omega(l-\varphi)},\ G = [\,G_1 \quad G_2\,],\ H = [\,H_1 \quad H_2\,],$$

$$G_1(l, r) = \frac{1}{|x_{l_i} - l_r|} e^{j\omega\left(\frac{|x_{l_i} - l_r|}{c}\right)};\ H_1(l, r) = \frac{1}{|x_{l_i} - l_v|} e^{j\omega\left(\frac{|x_{l_i} - l_v|}{c}\right)};$$

$$G_2(l, r) = \frac{\frac{1}{|x_{l_i} - l_r|} e^{j\omega\left(\frac{|x_{l_i} - l_r|}{c}\right)} \frac{\frac{1}{|x_{l_{i+1}} - l_r|} e^{j\omega\left(\frac{|x_{l_{i+1}} - l_r|}{c}\right)} - \frac{1}{|x_{l_{i-1}} - l_r|} e^{j\omega\left(\frac{|x_{l_{i-1}} - l_r|}{c}\right)}}{2\Delta r}}{}$$

$$H_2(l, r) = \frac{\frac{1}{|x_{l_{i+1}} - l_v|} e^{j\omega\left(\frac{|x_{l_{i+1}} - l_v|}{c}\right)} - \frac{1}{|x_{l_{i-1}} - l_v|} e^{j\omega\left(\frac{|x_{l_{i-1}} - l_v|}{c}\right)}}{2\Delta r}$$

wherein $G_1$ and $H_1$ are respectively the transfer function of the signal strength from the virtual loudspeaker to each point of the sound field and the transfer function of the signal strength from the real loudspeaker to each point of the sound field; $G_1(l,r)$ and $H_1(l,r)$ represent respective elements. $G_2$ and $H_2$ are respectively the transfer function of the gradient from the virtual loudspeaker to each point of the sound field and the transfer function of the gradient from real loudspeaker to each point of the sound field; $G_2(l,r)$ and $H_2(l,r)$ represent respective elements; $l_v$ is the location of the virtual loudspeaker; $l_r$ is the location of the real loudspeaker; $b \in R^{1\times M}$ and $e \in R^{1\times N}$ respectively represent vector magnitude of the virtual loudspeaker and vector magnitude of the real loudspeaker; $\phi$ is phase difference required for sound field reconstruction of each real loudspeaker; c is sound speed, $x_{l_{i-1}}$ is the position of the reference point P of the first closed geometric shape 1, $x_{l_i}$ is the position of the reference point P of the inner circle of the second closed geometric shape 2, $x_{l_{i+1}}$ is the position of the reference point P of the outermost circle of the second closed geometric shape 2; $\Delta r$ represents a distance between the reference point P of each circle; and $\omega$ represents angular velocity of the sound source. In order to make the real sound field become similar to the virtual sound field, the boundary condition is that the convolution of the transfer function from the real loudspeaker to each point of the sound field and sound source signal of the real to loudspeaker is equal to the real sound field.

Find a solution by minimizing the real sound field and the virtual sound field.

$$\min_o \|SF_r - vG\|_2^2$$

$$\text{s.t. } oH = SF_r,$$

The inverse matrix of H is unable to get directly since H is not square. Thus pseudo-inverse matrix $H^+$ is used to get the least square error solution. The singular value decomposition of H is used to construct the pseudo-inverse matrix as the following:

$$H_{N\times L} = U_{N\times N}\Sigma_{N\times L}V_{L\times L}^T \cdot \overline{H}^T(H\overline{H}^T)^{-1} = (\overline{V}\Sigma\overline{U}^T)(\overline{U}\Sigma^{-2}\overline{U}^T) = \overline{V}\Sigma^{-1}\overline{U}^T = H^+$$

Thus, the pseudo-inverse matrix $H^+$ is obtained.

Both sides of the constraint are multiplied by conjugate transpose matrix of H as the following: $oH\overline{H}^T = vG\overline{H}^T$, and then multiplied by inverse of $H\overline{H}^T$:

$$o = vG\overline{H}^T(H\overline{H}^T)^{-1}$$

An optimal sound source signal of the real sound field is obtained: $o^* = vA$, wherein the matrix A is represented as:

$$A = GH^T(HH^T)^{-1}$$

Thereby we can observe the time differences and the strength to differences of the real loudspeaker that can produce a sound field similar to the virtual sound field.

At last, signals of the real loudspeaker are obtained which minimizes the square error:

$$\text{error} = \|SF_r - SF_v\|_2^2.$$

In summary, the virtual sound source signal is substituted into the transfer function from the virtual loudspeaker to each point of the sound field to form the virtual sound field while the sound source signal of the real sound field (signal of the real loudspeaker) is obtained by the virtual sound field and opposite transfer function from the real loudspeaker to each point of the sound field. The signal of the real loudspeaker is calculated by the minimization of the error between the real sound field and the virtual sound field around the listener. Thus the optimum sound field can be obtained in the least square error sense under any conditions. Thereby the listener can get an optimal sound effect within a sound field produced by loudspeakers even they slightly turn their heads or shift their bodies. Moreover, the present invention can be applied to home theaters or car audio systems. The loudspeakers can produce a sound field around the listener and generate a sound signal required.

Figure 3:
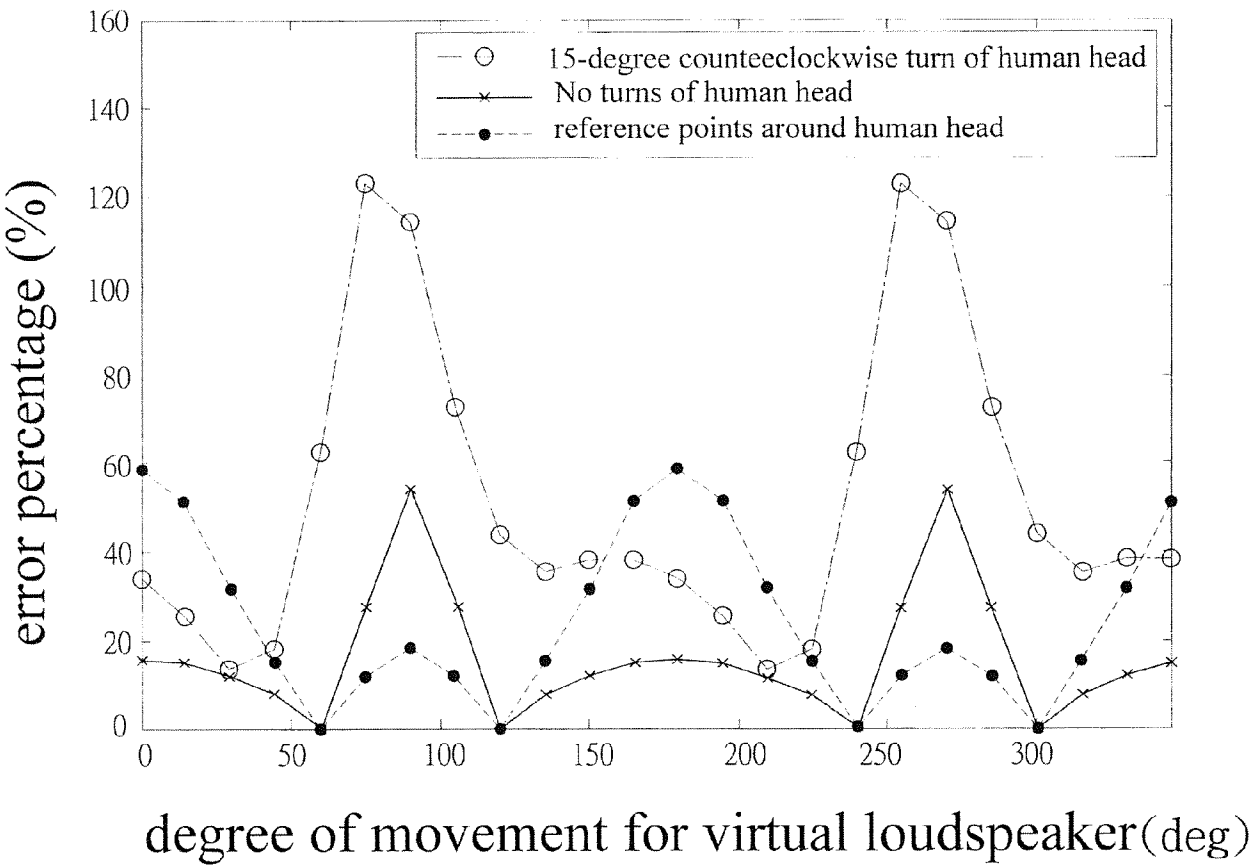
FIG. 3 is a schematic drawing showing comparison results of errors of an embodiment according to the present invention and errors of a sound field based on duplex theory available now.
Figure 4:
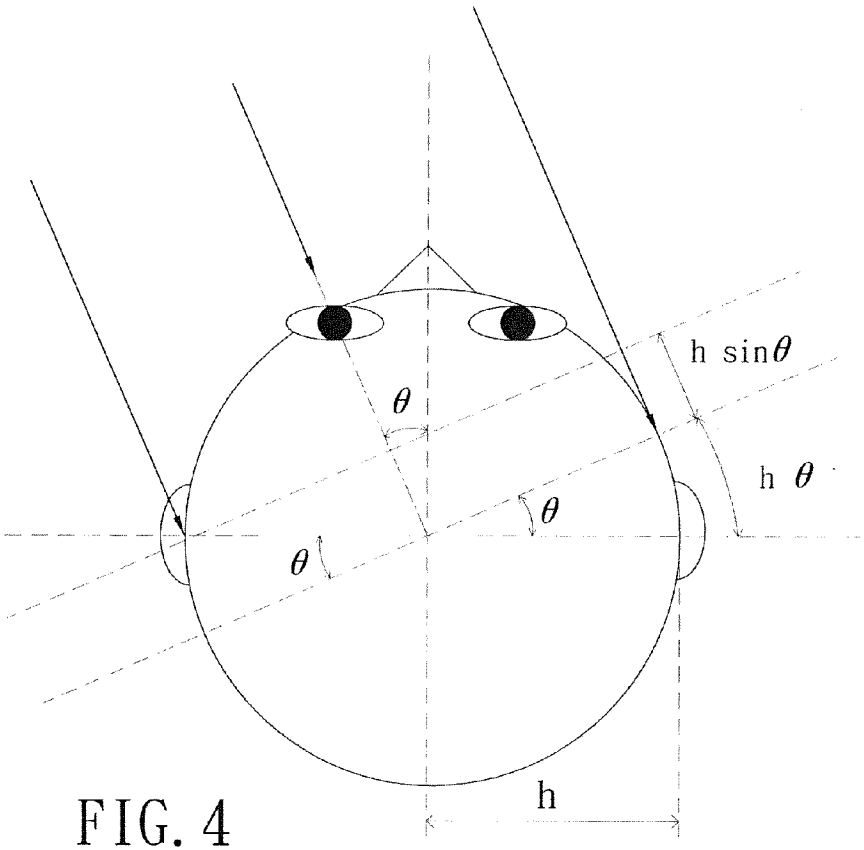
FIG. 4 is a schematic drawing showing a sound field produced between two ears of a listener by duplex theory available now.

Refer to FIG. 3, a schematic drawing showing comparison of error of an embodiment with the error of the duplex theory available now while the listener is turning his head. A dashed line with filled circles represents data of the embodiment of the present invention. A solid line with x markers represents data of the duplex theory while a dotted line with empty circles represents data of the duplex theory when the listener turns his head counterclockwise 15 degrees. The horizontal axis is the degree (deg) the virtual loudspeaker moves and the vertical axis is the error percentage (%). It is obvious that the turning of the head has great effect on the error of the reproduction of sound field by the duplex theory. When the listener turns his head 15 degrees, the error percentage of the duplex theory is over the simulation error around the head of the embodiment of the present invention. It is approved that the sound field error becomes larger while the listener turning the head.

In accordance with the above embodiments, it is learned that the present invention has following advantages 1. Compared with conventional duplex theory only based on two ears to observe the differences, the present invention sets up a plurality of reference points within a small range around the listener's head to synthesize a virtual loudspeaker in the desired direction. Thus the direction of the virtual loudspeaker the listener perceived will not change when the listener turns the head, change or move the body slightly but the head is still within a certain range.
2. The present invention sets up reference points around the sound field required to get audio signals on the boundary of the sound field and related gradient. Then use an optimization method to calculate output signals of each loudspeaker for producing the sound field required. The present invention produces the sound field required without placing a plurality of loudspeakers on the boundary. Thus not only the problem of placing the loudspeakers in a constrained space can be solved, the huge cost for buying the loudspeakers is also saved. Therefore users have a higher acceptance and use, and the present invention is widely adopted.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A method for producing an optimum sound field of loudspeakers comprising the steps of:

Step one: enclosing a surface of a human head with a first closed geometric shape;

Step two: enclosing the first closed geometric shape with at least one second closed geometric shape, outside the human head while the first closed geometric shape and the second closed geometric shape are similar to each other;

Step three: setting up a plurality of reference points on the first closed geometric shape and on the second closed geometric shape respectively; the reference point on the first closed geometric shape is corresponding to the reference point on the second closed geometric shape Step four: using signal strength of the reference point on the second closed geometric shape and a gradient of the corresponding reference points on the first and the second closed geometric shapes to form a transfer function from a virtual loudspeaker to each point of a sound field and a transfer function from a real loudspeaker to each point of the sound field, respectively;

Step five: creating a virtual sound field and a real sound field according to the transfer function of the virtual loudspeaker and the transfer function of the real loudspeaker respectively; and Step six: obtaining an optimum signal of the real loudspeaker by minimizing an error between the virtual sound field and the real sound field with a boundary condition.

2. The method as claimed in claim 1, wherein in the step six, the step of obtaining an optimum signal includes a pseudo-inverse matrix method that finds a solution.

3. The method as claimed in claim 1, wherein the boundary condition is that the convolution of the transfer function from the real loudspeaker to each point of the sound field and sound source signal of the real loudspeaker is equal to the real sound field.

4. The method as claimed in claim 1, wherein the number of the real loudspeaker is smaller than the number of the reference point.

5. The method as claimed in claim 1, wherein the first closed geometric shape and the second closed geometric shape are selected from the group consisting of a triangle, a square, a circle, and an ellipse.

6. The method as claimed in claim 5, wherein the first closed geometric shape and the second closed geometric shape are concentric circles with different radii.

7. The method as claimed in claim 6, wherein there are two second closed geometric shapes whose radii are respectively between 9.5-13 centimeters (cm) and 11.5-18 cm while a radius of the first closed geometric shape is ranging from 6 cm to 8.5 cm.

8. The method as claimed in claim 1, wherein intervals between adjacent reference points are the same.

9. The method as claimed in claim 8, wherein the number of the reference point is ranging from 12 to 36 and an interval between two adjacent reference points is ranging from 10 degrees to 15 degrees.

* * * * *